US011163241B2

(12) United States Patent
Ito et al.

(10) Patent No.: US 11,163,241 B2
(45) Date of Patent: Nov. 2, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yota Ito, Mishima (JP); Jumpei Kuno, Yokohama (JP); Shoma Hinata, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/269,304

(22) Filed: Feb. 6, 2019

(65) Prior Publication Data

US 2019/0243260 A1 Aug. 8, 2019

(30) Foreign Application Priority Data

Feb. 8, 2018 (JP) ..... JP2018-021340

(51) Int. Cl.

| | |
|---|---|
| ***G03G 5/14*** | (2006.01) |
| ***G03G 5/06*** | (2006.01) |
| ***G03G 5/05*** | (2006.01) |

(52) U.S. Cl.

CPC ..... *G03G 5/144* (2013.01); *G03G 5/0542* (2013.01); *G03G 5/0696* (2013.01); *G03G 5/142* (2013.01)

(58) Field of Classification Search

CPC ..... G03G 5/14; G03G 5/142; G03G 5/144

See application file for complete search history.

(56) References Cited

U.S. PATENT DOCUMENTS

2010/0183330 A1* 7/2010 Wada ..... G03G 5/047 399/116

2016/0139516 A1* 5/2016 Kawahara ..... G03G 5/0696 399/111

FOREIGN PATENT DOCUMENTS

| | | |
|---|---|---|
| EP | 1813991 A1 | 8/2007 |
| EP | 2317389 A1 | 5/2011 |
| EP | 2733539 A1 | 5/2014 |

(Continued)

*Primary Examiner* — Peter L Vajda

(74) *Attorney, Agent, or Firm* — Canon U.S.A., Inc., IP Division

(57) ABSTRACT

An electrophotographic photosensitive member including: a support, an undercoat layer formed above the support, a charge generation layer formed on the undercoat layer, and a charge transport layer formed above the charge generation layer, wherein the undercoat layer contains a polyamide resin and a titanium oxide particle which is surface-treated with a compound represented by Formula (1):

(1)

when a volume of the titanium oxide particles to a volume of the polyamide resin in the undercoat layer is a, and an average primary particle diameter of the titanium oxide particles is b [μm], the following Equation (A) is satisfied: Equation (A): 14.0≤a/b≤19.1; and the charge generation layer contains a charge generating material and a thermoplastic resin having a hydroxyl group and a hydroxyl number of 50 mgKOH/g or more.

13 Claims, 2 Drawing Sheets

(56) References Cited

FOREIGN PATENT DOCUMENTS

| | | | |
|---|---|---|---|
| JP | 2009-151329 | A | 7/2009 |
| JP | 2014-182296 | A | 9/2014 |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, a process cartridge having the electrophotographic photosensitive member, and an electrophotographic apparatus.

Description of the Related Art

As an electrophotographic photosensitive member mounted on a process cartridge or an electrophotographic apparatus, an electrophotographic photosensitive member containing an organic optical conductive material (charge generating material) is used. The electrophotographic photosensitive member generally has a support, a photosensitive layer formed above the support, a charge generation layer, and a charge transport layer formed above the charge generation layer. As the photosensitive layer, a laminated photosensitive layer in which the charge transport layer containing a charge transporting material is laminated on the charge generation layer containing the charge generating material is preferably used. In addition, for the purpose of increasing adhesive strength between the support and the photosensitive layer, suppressing charge injection from the support to the charge generation layer side, and suppressing occurrence of image defects such as fogging and leakage, an undercoat layer is often provided between the support and the charge generation layer.

As the undercoat layer which suppresses charge injection from the support to the charge generation layer side to suppress the occurrence of image defects such as fogging and leakage, an undercoat layer in which metal oxide particles are dispersed in a resin is used.

Recently, an electrophotographic apparatus having a longer life is required, and for stability or environmental stability in repetitive use of the electrophotographic photosensitive member, an undercoat layer having low charge accumulation due to repetitive use for a long period of time is required.

As the undercoat layer having low charge accumulation, Japanese Patent Application Laid-Open No. 2009-151329 discloses a technology of using a polyamide resin and surface-treated metal oxide particles.

In addition, Japanese Patent Application Laid-Open No. 2014-182296 discloses a technology of using a silane coupling agent having no amino group as a surface treatment agent of metal oxide particles.

Recently, an electrophotographic photosensitive member having a longer life is desired, and for stability and environmental stability of the electrophotographic photosensitive member in repetitive use for a long period of time, an electrophotographic photosensitive member having suppressed charge accumulation by an undercoat layer and higher adhesive strength between a support and a photosensitive layer is required.

The present inventors reviewed this issue, and as a result, found that in the technologies disclosed in Japanese Patent Application Laid-Open No. 2009-151329 and Japanese Patent Application Laid-Open No. 2014-182296, the adhesive strength between the support and the photosensitive layer is not sufficient for the repetitive use for a long period of time, and thus, the photosensitive layer may be peeled off.

SUMMARY OF THE INVENTION

An aspect of the present disclosure is to provide an electrophotographic photosensitive member in which charge accumulation due to repetitive use for a long period of time is suppressed and peeling of a photosensitive layer is suppressed, and a process cartridge and an electrophotographic apparatus having the electrophotographic photosensitive member.

An electrophotographic photosensitive member of the present disclosure includes a support, an undercoat layer formed above the support, a charge generation layer formed on the undercoat layer, and a charge transport layer formed above the charge generation layer, wherein the undercoat layer contains a polyamide resin and a titanium oxide particle which is surface-treated with a compound represented by the following Formula (1):

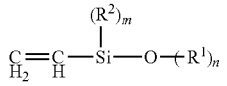

(1)

wherein $R^1$ denotes a methyl group, an ethyl group, an acetyl group, or a 2-methoxyethyl group; $R^2$ denotes a hydrogen atom or a methyl group; and m+n=3, m is an integer of 0 or more, and n is an integer of 1 or more, with a proviso that when n is 3, $R^2$ does not exist;

when a volume of the titanium oxide particles to a volume of the polyamide resin in the undercoat layer is a, and an average primary particle diameter of the titanium oxide particles is b [μm], the following Equation (A) is satisfied: Equation (A): $14.0 \leq a/b \leq 19.1$; and the charge generation layer contains a charge generating material and a thermoplastic resin having a hydroxyl group and a hydroxyl number of 50 mgKOH/g or more.

In addition, the present disclosure relates to a process cartridge which supports the electrophotographic photosensitive member and at least one unit selected from the group consisting of a charging unit, a developing unit, and a cleaning unit, and is detachably attachable to an electrophotographic apparatus body.

In addition, the present disclosure relates to an electrophotographic apparatus including the electrophotographic photosensitive member, and a charging unit, an exposing unit, a developing unit, and a transferring unit.

Further features of the present disclosure will become apparent from the following description of exemplary embodiments with reference to the attached drawings.

DESCRIPTION OF THE EMBODIMENTS

Figure 1:
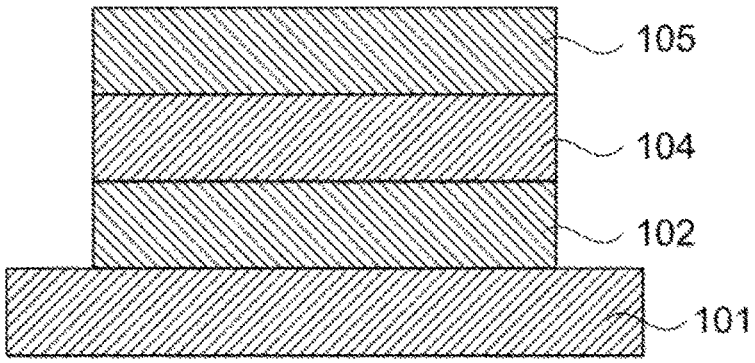
FIG. 1 is a drawing illustrating an example of a layer configuration of an electrophotographic photosensitive member.

An electrophotographic photosensitive member of the present disclosure includes a support, an undercoat layer formed above the support, a charge generation layer formed on the undercoat layer, and a charge transport layer formed above the charge generation layer, wherein the undercoat layer contains a polyamide resin and a titanium oxide particle which is surface-treated with a compound represented by the following Formula (1):

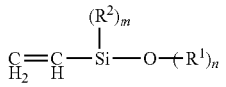

(1)

wherein $R^1$ denotes a methyl group, an ethyl group, an acetyl group, or a 2-methoxyethyl group; $R^2$ denotes a hydrogen atom or a methyl group; and m+n=3, m is an integer of 0 or more, and n is an integer of 1 or more, with a proviso that when n is 3, $R^2$ does not exist;

when a volume of the titanium oxide particles to a volume of the polyamide resin in the undercoat layer is a, and an average primary particle diameter of the titanium oxide particles is b [μm], the following Equation (A) is satisfied: Equation (A): $14.0 \leq a/b \leq 19.1$; and the charge generation layer contains a charge generating material and a thermoplastic resin having a hydroxyl group and a hydroxyl number of 50 mgKOH/g or more.

The present inventors presumes the reason why the relevant electrophotographic photosensitive member has suppressed accumulation of charges even by repetitive use for a long period of time and suppressed peeling of the photosensitive layer, as follows.

In order to suppress peeling of the photosensitive layer, it is required to increase adhesive strength between the photosensitive layer and the undercoat layer. In the present disclosure, in order to increase adhesive strength between the undercoat layer containing a polyamide resin and titanium oxide (titanium dioxide, $TiO_2$) particles and the thermoplastic resin having a hydroxyl group and a hydroxyl number of 50 mgKOH/g or more, used in the charge generation layer on the undercoat layer, titanium oxide particles which are treated with a compound represented by Formula (1) having an unsaturated bond on the surface thereof are used. It is considered that by having an unsaturated bond having high cohesive energy, adhesive strength between the charge generation layer and the titanium oxide particles present on the surface of the undercoat layer is increased, thereby suppressing the peeling of the photosensitive layer.

In addition, in order to suppress accumulation of charges staying in the undercoat layer, it is preferred that the titanium oxide particles are uniformly dispersed in the undercoat layer, and by selecting a silane coupling agent having a short chain length of Formula (1), hydrophobicity of the surface of titanium oxide particles is increased, while entanglement between the surface-treated compounds becomes difficult to occur, whereby the titanium oxide particles are uniformly dispersed.

As described above, in order to have both effects of suppressing peeling of the photosensitive layer and suppressing accumulation of charges staying in the undercoat layer in a high level, it was found that there is a better value of the volume ratio of the titanium oxide particles and the polyamide resin (the volume of the titanium oxide particles to the volume of the polyamide resin) in the undercoat layer, depending on an average primary particle diameter of the titanium oxide particles which have been surface-treated with the compound represented by Formula (1). The result is a relation formula of Equation (A). That is, when the volume of the titanium oxide particles to the volume of the polyamide resin in the undercoat layer is a, and an average primary particle diameter of the titanium oxide particles is b [μm], the following Equation (A) is satisfied: Equation (A): $14.0 \leq a/b \leq 19.1$. When the value of Equation (A) is less than 14.0, the effect of suppressing accumulation of charges staying in the undercoat layer in the present disclosure is at an unsatisfactory level, and when the value of Equation (A) is more than 19.1, the effect of suppressing peeling of the photosensitive layer is at an unsatisfactory level.

The electrophotographic photosensitive member of the present disclosure includes a support, an undercoat layer formed above the support, a charge generation layer formed on the undercoat layer, and a charge transport layer formed above the charge generation layer.

FIG. 1 is a drawing illustrating an example of a layer configuration of the electrophotographic photosensitive member. In FIG. 1, the electrophotographic photosensitive member includes a support 101, an undercoat layer 102, a charge generation layer 104, and a charge transport layer 105.

[Support]

As a support, a support having conductivity (conductive support) is preferred, and for example, a support formed of a metal such as aluminum, iron, nickel, copper and gold, or an alloy of these metals can be used. In addition, a support in which a thin film formed of a metal such as aluminum, chromium, silver and gold is formed on an insulating support such as a polyester resin, a polycarbonate resin, a polyimide resin, and glass, or a support in which a thin film formed of a conductive material such as indium oxide and tin oxide on the insulating support may be used. On the surface of the support, electrochemical treatment such as positive electrode oxidation or a wet honing treatment, a blast treatment, a cutting treatment, or the like may be performed, for improving electrical properties or suppressing interference fringes.

A conductive layer may be provided between the support and the undercoat layer. The conductive layer is obtained by forming a coating film of a coating solution for the conductive layer in which conductive particles are dispersed in a resin on the support, and drying the film.

[Undercoat Layer]

An undercoat layer is provided between the support and a charge generation layer.

The undercoat layer contains a polyamide resin and titanium oxide particles which have been surface-treated with a compound represented by Formula (1), and satisfies Equation (A).

As the polyamide resin, a polyamide resin which is soluble in an alcohol-based solvent is preferred. For example, a ternary (6-66-610) copolymerized polyamide, a quaternary (6-66-610-12) copolymerized polyamide, N-methoxymethylated nylon, a polymerized fatty acid-based polyamide, a polymerized fatty acid-based polyamide block copolymer, a copolymerized polyamide having a diamine component, and the like are preferably used.

As the titanium oxide particles, from the viewpoint of suppressing accumulation of charges, the crystal structure is preferably a rutile type or an anatase type, and more preferably a rutile type having a weak photocatalytic activity. In the case of the rutile type, it is preferred that a rutilization ratio is 90% or more. A shape of the titanium oxide particles is preferably a spherical shape, and the average primary particle diameter b [μm] is preferably 0.006 or more and 0.180 or less, and more preferably 0.015 or more and 0.085 or less, from the viewpoint of suppressing accumulation of charges, and uniform dispersibility. The titanium oxide particles are surface-treated with the compound represented by Formula (1), and from the viewpoint of suppressing peeling of the photosensitive layer, and uniform dispersibility, it is preferred that the compound has a low molecular weight, and if $R^2$ is present, $R^2$ is a methyl group. Specifically, it is more preferred that the compound represented by Formula (1) is at least one selected from the group consisting of vinyltrimethoxysilane, vinyltriethoxysilane, and vinylmethyldimethoxysilane.

It is preferred that the volume ratio of the titanium oxide particles and the polyamide resin, a (the volume of the titanium oxide particles to the volume of the polyamide resin) in the undercoat layer is 0.2 or more and 1.0 or less. When a is less than 0.2, the effect of suppressing accumulation of charges in the present disclosure is not sufficiently obtained, and when a is more than 1.0, the effect of suppressing peeling of the photosensitive layer in the present disclosure is not sufficiently obtained. A more preferred range of a is 0.3 or more and less than 0.8.

In particular, a and b satisfy the relation formula of the following Equation (A) among the preferred ranges, thereby having both effects of suppressing peeling of the photosensitive layer and suppressing accumulation of charges staying in the undercoat layer in a high level.

$$14.0 \le a/b \le 19.1 \quad \text{Equation (A):}$$

When a value of a/b is less than 14.0, an effect of suppressing accumulation of charges staying in the undercoat layer in the present disclosure is at an unsatisfactory level, and when the value is more than 19.1, an effect of suppressing peeling of the photosensitive layer is at an unsatisfactory level. More preferably, the value of a/b satisfies the relation formula of the following Equation (A').

$$14.8 \le a/b \le 17.4 \quad \text{Equation (A'):}$$

In addition, it is preferred that a surface treatment amount of the titanium oxide particles which have been surface-treated with the compound represented by Formula (1) satisfies the relation formula of the following Equation (B). That is, when a content ratio of a Si element of the compound represented by Formula (1) to $TiO_2$ of the titanium oxide particles in the undercoat layer is c [mass %], it is preferred that the following Equation (B) is satisfied.

$$0.015 \le b \times c \le 0.030 \quad \text{Equation (B):}$$

When a value of b×c is 0.015 or more, uniform dispersibility of the titanium oxide particles in the undercoat layer is improved, thereby increasing an effect of suppressing occurrence of image defects such as fogging and leakage. When the value is 0.030 or less, an effect of suppressing accumulation of charges staying in the undercoat layer is increased. More preferably, the relation formula of the following Equation (B') is satisfied.

$$0.020 \le b \times c \le 0.027 \quad \text{Equation (B'):}$$

It is preferred that a film thickness d [μm] of the undercoat layer satisfies the following Equation (C).

$$0.5 \le d \le 3.0 \quad \text{Equation (C):}$$

When d is 0.5 or more, an effect of suppressing peeling of the photosensitive layer is increased, and when d is 3.0 or less, an effect of suppressing accumulation of charges staying in the undercoat layer is increased.

In addition, it is preferred that the relation formula of the following Equation (D) is satisfied.

$$0.15 \le a/d \le 0.55 \quad \text{Equation (D):}$$

By satisfying both relation formulae of Equation (A) and Equation (D), the two effects of suppressing peeling of the photosensitive layer and the effect of suppressing accumulation of charges staying in the undercoat layer can be compatible to a higher level. More preferably, the relation formula of the following Equation (D') is satisfied.

$$0.30 \le a/d \le 0.42 \quad \text{Equation (D'):}$$

In addition, when a hydrophobized degree of the titanium oxide particles which have been surface-treated with the compound represented by Formula (1) is e [%], it is preferred that e is 10 or more and 40 or less, since dispersibility in the polyamide resin is increased, and accumulation of charges staying in the undercoat layer is suppressed.

For a relationship between Equation (B) and e, in order to achieve the effects of the present disclosure to a higher level, it is more preferred that the following Equation (E) is satisfied.

$$0.25 \le b \times c \times e \le 1.05 \quad \text{Equation (E):}$$

The titanium oxide particles may be surface-treated with inorganic materials such as $Al_2O_3$, before being surface-treated with the compound represented by Formula (1), however, even in the case of being surface-treated with inorganic materials including a Si element, it is preferred to perform treatment so that Equation (B) is satisfied. However, it is preferred not to perform surface treatment with inorganic materials.

The undercoat layer in the present disclosure may contain an additive such as organic particles or a leveling agent, for the purpose of increasing an effect of preventing an interference fringe of the electrophotographic photosensitive member or increasing film formability of the undercoat layer, in addition to the polyamide resin or the titanium oxide particles. However, a content of the additive in the undercoat layer is preferably 10% by mass or less, based on the total mass of the undercoat layer.

The undercoat layer may be provided as two or more layers, for the purpose of separating the function. In this case, the layer which is disposed on the uppermost layer in a plurality of the undercoat layers and at least in contact with the charge generation layer contains the polyamide resin and the titanium oxide particles which have been surface-treated with the compound represented by Formula (1), and should satisfy Equation (A).

[Charge Generation Layer]

A charge generation layer is provided on the undercoat layer.

The charge generation layer contains a charge generating material and a thermoplastic resin having a hydroxyl group and a hydroxy number of 50 mgKOH/g or more.

As the charge generating material used in the charge generation layer, an azo pigment, a perylene pigment, an anthraquinone derivative, an anthanthrone derivative, a dibenzopyrene quinone derivative, a pyranthrone derivative, a violanthrone derivative, an isoviolanthrone derivative, an indigo derivative, a thioindigo derivative, a phthalocyanine pigment such as metal phthalocyanine and non-metal phthalocyanine, a bisbenzimidazole derivative, or the like can be mentioned. Among them, a phthalocyanine pigment is preferred. Among the phthalocyanine pigments, oxytitanium phthalocyanine, chlorogallium phthalocyanine, and hydroxygallium phthalocyanine are preferred. In addition, in order to further increase the effect of suppressing peeling of the photosensitive layer in the present disclosure, the charge generating material also has a hydroxyl group, together with the resin used in the charge generation layer, and from the viewpoint, hydroxygallium phthalocyanine is more preferred.

As the thermoplastic resin having a hydroxyl group and a hydroxyl number of 50 mgKOH/g or more, for example, a polyvinylacetal resin such as a polyvinylbutyral resin, a polyolefin resin such as an ethylenevinylalcohol copolymerized resin, a polyol resin such as a polyester polyol resin, or the like can be mentioned. In order to further increase the effect of suppressing peeling of the photosensitive layer in the present disclosure, it is preferred that the hydroxyl number is 100 mgKOH/g or more. The thermoplastic resin having a hydroxyl group and a hydroxyl number of 50 mgKOH/g or more has a weight average molecular weight in a range of 5,000 to 400,000.

In the charge generation layer, a mass ratio of the charge generating material and a binder resin (charge generating material/binder resin) is preferably in a range of 10/1 to 1/10, and more preferably in a range of 5/1 to 1/5. It is preferred that the charge generation layer has a film thickness of 0.05 μm or more and 5 μm or less. A solvent used in a coating solution for the charge generation layer may include an alcohol-based solvent, a sulfoxide-based solvent, a ketone-based solvent, an ether-based solvent, an ester-based solvent, an aromatic hydrocarbon solvent, or the like.

[Charge transport layer]

A charge transport layer is provided above the charge generation layer.

As a charge transporting material used in the charge transport layer, for example, a polycyclic aromatic compound, a heterocyclic compound, a hydrazone compound, a styryl compound, a benzidine compound, a triarylamine compound, triphenylamine, or the like can be mentioned. In addition, a polymer having a group derived from these compounds in the main chain or the side chain can be mentioned.

As a binder resin used in the charge transport layer, a polyester resin, a polycarbonate resin, a polymethacrylic acid ester resin, a polyarylate resin, a polysulfone resin, a polystyrene resin, or the like can be mentioned. Among them, a polycarbonate resin and a polyarylate resin are preferred. It is preferred that the binder resin has a weight average molecular weight in a range of 10,000 to 300,000.

In the charge transport layer, a mass ratio of the charge transporting material and the binder resin (charge transporting material/binder resin) is preferably in a range of 10/5 to 5/10, and more preferably in a range of 10/8 to 6/10. The charge transport layer has a film thickness of preferably 5 μm or more and 40 μm or less, and more preferably 15 μm or more and 25 μm or less.

A solvent used in a coating solution for the charge transport layer may be an alcohol-based solvent, a sulfoxide-based solvent, a ketone-based solvent, an ether-based solvent, an ester-based solvent, an aromatic hydrocarbon solvent, or the like.

In addition, on the charge transport layer, a protection layer (surface protection layer) containing conductive particles or the charge transporting material and the binder resin may be provided. In the protection layer, an additive such as a lubricant may be further contained. In addition, the binder resin itself of the protection layer may have conductivity or a charge transporting property, and in this case, the protection layer may not contain the conductive particles or the charge transporting material other than the binder resin. In addition, the binder resin of the protection layer may be a thermoplastic resin, or a curable resin formed by curing by heat, light, radiation (electron beam, etc.), or the like.

As a method of forming each layer constituting the electrophotographic photosensitive member such as the conductive layer, the undercoat layer, the charge generation layer, and the charge transport layer, the following method is preferred. That is, a coating solution obtained by dissolving and/or dispersing materials constituting each layer in a solvent is coated to form a coating film, and the obtained coating film is dried and/or cured to form the layer. As a method of coating the coating solution, for example, a dip application (dip coating) method, a spray coating method, a curtain coating method, a spin coating method, Ling's method, or the like can be mentioned. Among them, a dip coating method is preferred from the viewpoint of efficiency and productivity.

[Process Cartridge and Electrophotographic Apparatus]

Figure 2:
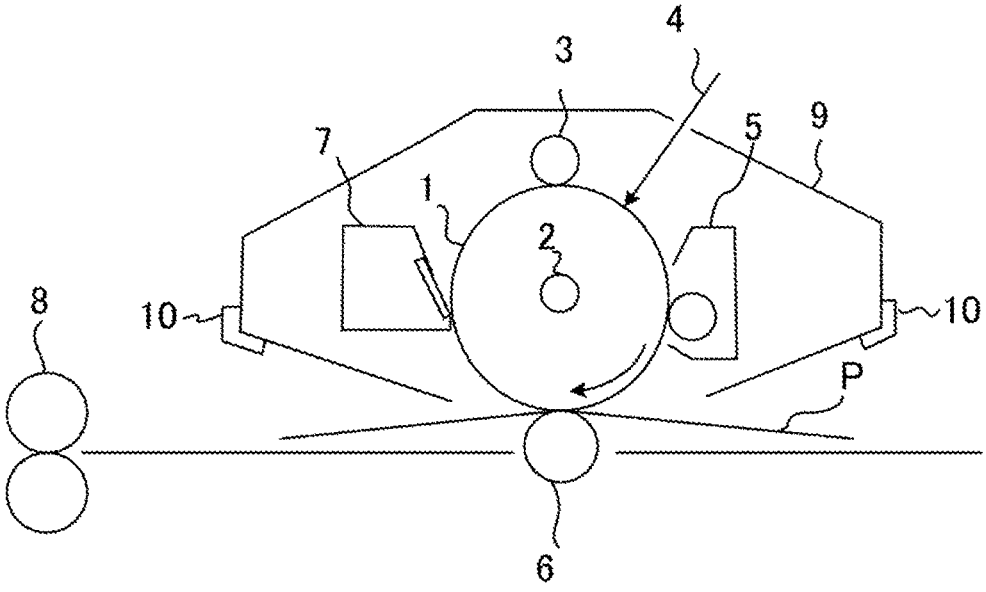
FIG. 2 is a drawing illustrating a schematic configuration of an electrophotographic apparatus having a process cartridge equipped with an electrophotographic photosensitive member.

FIG. 2 illustrates an example of a schematic configuration of the electrophotographic apparatus having a process cartridge equipped with the electrophotographic photosensitive member of the present disclosure.

The electrophotographic apparatus illustrated in FIG. 2 has a cylindrical electrophotographic photosensitive member 1, and is rotated and driven at a predetermined circumferential speed in an arrow direction about an axis 2. A surface (circumference surface) of the rotated and driven electrophotographic photosensitive member 1 is uniformly charged in positive or negative predetermined potential by a charging unit 3 (primary charging unit: charging roller, etc.). Then, the surface of the uniformly charged electrophotographic photosensitive member 1 is exposed by exposure light (image exposure light) 4 from an exposing unit (not shown) such as slit exposure or laser beam scanning exposure. Thus, on the surface of the electrophotographic photosensitive member 1, an electrostatic latent image corresponding to the desired image is sequentially formed.

The electrostatic latent image formed on the surface of the electrophotographic photosensitive member 1 is then developed by a toner contained in a developer of a developing unit 5 to be a toner image. Then, the toner image formed and carried on the surface of the electrophotographic photosensitive member 1 is sequentially transferred on a transfer material (such as paper) P by a transfer bias from a transferring unit (such as a transfer roller) 6. In addition, the transfer material P is taken out synchronously with rotation of the electrophotographic photosensitive member 1 between the electrophotographic photosensitive member 1 and the transferring unit 6 (contact part) from a transfer material supply unit (not shown), and fed.

The transfer material (P) on which the toner image has been transferred is separated from the surface of the electrophotographic photosensitive member 1 and introduced to a fixing unit 8 to fix the image, thereby being discharged outside the apparatus as an image formed object (print or copy).

The surface of the electrophotographic photosensitive member 1 after transferring the toner image is cleaned by removing a transfer residual developer (transfer residual toner) by a cleaning unit 7 (cleaning blade, etc.). Then, the cleaned surface of the electrophotographic photosensitive member 1 is subject to electricity removal by pre-exposure (not shown) from a pre-exposing unit (not shown), and then used for forming a repetitive image. In addition, as shown in FIG. 2, when the charging unit 3 is a contact charging unit using a charging roller or the like, pre-exposure is not necessary.

A plurality of constitutional elements selected from the constitutional elements such as the electrophotographic photosensitive member 1, the charging unit 3, the developing unit 5, the transferring unit 6, and the cleaning unit 7, was stored in a container, and integrally supported as the process cartridge. This process cartridge can be configured to be detachably attached to an electrophotographic apparatus body such as a copying machine and a laser beam printer. In FIG. 2, the electrophotographic photosensitive member 1 with the charging unit 3, the developing unit 5 and the cleaning unit 7 is integrally supported to be a cartridge, which is a process cartridge 9 detachably attached to the electrophotographic apparatus body, using a guiding unit 10 such as a rail of the electrophotographic apparatus body.

The present disclosure provides an electrophotographic photosensitive member in which accumulation of charges due to repetitive use for a long period of time is suppressed and peeling of a photosensitive layer is suppressed, and a process cartridge and an electrophotographic apparatus having the electrophotographic photosensitive member.

EXAMPLES

Hereinafter, the present disclosure will be described in more detail, by the Examples and the Comparative Examples, however, the present invention is not limited thereto. In addition, "parts" in the Examples and the Comparative Examples refer to "parts by mass".

Example 1

An aluminum cylinder having a length of 260.5 mm and a diameter of 30 mm (JIS H 4000: 2006 A3003P, aluminum alloy) was subjected to a cutting process (JIS B 0601: 2014, 10-point average roughness Rzjis: 0.8 μm), and the product therefrom was used as a support (conductive support).

Then, 100 parts of rutile type titanium oxide particles (average primary particle diameter: 50 nm, manufactured by TAYCA CORPORATION) was mixed with 500 parts of toluene with stirring, 3.0 parts of vinyltrimethoxysilane wherein m=0, n=3, and $R^1$ is a methyl group in Formula (1) (product name: KBM-1003, manufactured by Shin-Etsu Chemical Co., Ltd.) was added, and stirring was performed for 8 hours. Thereafter, toluene was distilled off by distillation under reduced pressure, and drying was performed at 120° C. for 3 hours, thereby obtaining rutile type titanium oxide particles which had been surface-treated with vinyltrimethoxysilane.

To a mixed solvent of 90 parts of methanol and 60 parts of 1-butanol, 18 parts of the rutile type titanium oxide particles which had been surface-treated with vinyltrimethoxysilane, 4.5 parts of N-methoxymethylated nylon (product name: TORESIN EF-30T, manufactured by Nagase ChemteX Corporation), and 1.5 parts of a copolymerized nylon resin (product name: AMILAN CM8000, manufactured by Toray Industries, Inc.) were added to prepare a dispersion solution.

This dispersion solution was dispersed for 5 hours with a vertical sand mill using glass beads having a diameter of 1.0 mm, thereby preparing a coating solution for an undercoat layer. This coating solution for an undercoat layer was dip-coated on the support, and the obtained coating film was dried at 100° C. for 10 minutes, thereby forming an undercoat layer having a film thickness of 2.0 μm.

This undercoat layer had the following parameters: a=0.78, b=0.050, c=0.45, d=2.0, and Equation (A): a/b=15.6, Equation (B): bc=0.023, Equation (C): d=2.0, Equation (D): a/d=0.39. The value of a was obtained by manufacturing the electrophotographic photosensitive member, and then obtaining a section of the electrophotographic photosensitive member from a microscopic image using a field emission scanning electron microscope (FE-SEM, product name: S-4800, manufactured by Hitachi High-Technologies Corporation). The value of c was obtained as follows: titanium oxide particles which had been surface-treated with the compound represented by Formula (1) were manufactured, and assuming that only the detected Ti element is an oxide from the analysis result using a wavelength dispersion type fluorescence X-ray analyzer (XRF, product name: Axios advanced, manufactured by PANalytical), c was calculated from a content (% by mass) of an Si element to $TiO_2$ with a software (SpectraEvaluation, vertion 5.0L). The value of e was obtained by measuring methanol wettability of the titanium oxide particles which had been surface-treated with the compound represented by Formula (1). Measurement of methanol wettability was performed, as described below, using a powder wettability tester (product name: WET100P, manufactured by RHESCA Co., LTD.). To a 200 ml beaker, 0.2 g of titanium oxide particles which had been surface-treated with the compound represented by Formula (1) and 50 g of ion exchange water were added, and methanol was added dropwise while slowly stirring the reactants in the beaker using a burette. When a dropping amount of methanol where a light transmittance of the inside of the beaker was 10%, was t, a value of the hydrophobized degree e was calculated from e=100×t/(t+50).

Then, a hydroxygallium phthalocyanine crystal having peaks at Bragg angles (2θ±0.2°) of 7.5°, 9.9°, 12.5°, 16.3°, 18.6°, 25.1°, and 28.3° in CuKα characteristic X-ray diffraction (charge generating material) was prepared. To a vertical sand mill, 10 parts of this hydroxygallium phthalocyanine crystal, 5 parts of a polyvinylbutyral resin (product name: S-Lec BX-1, hydroxyl number: 173 mgKOH/g, manufactured by Sekisui Chemical CO., LTD.), and 260 parts of cyclohexanone were added and, using glass beads having a diameter of 1.0 mm, dispersed for 1.5 hours. Then, 240 parts of ethyl acetate was added thereto, thereby preparing a coating solution for a charge generation layer. This coating solution for a charge generation layer was dip-coated on the undercoat layer, and the obtained coating film was dried at 80° C. for 10 minutes, thereby forming a charge generation layer having a film thickness of 0.25 μm.

Then, 10 parts of an amine compound represented by the following Formula (2), and 10 parts of a polyarylate resin having a structural unit represented by the following Formula (3-1) and a structural unit represented by the following Formula (3-2) at a ratio of 5/5, and having a weight average molecular weight of 100,000 were dissolved in a mixed solvent of 30 parts of dimethoxymethane and 70 parts of chlorobenzene, thereby preparing a coating solution for a charge transport layer. This coating solution for a charge transport layer was dip-coated on the charge generation layer, and the obtained coating film was dried at 120° C. for 60 minutes, thereby forming a charge transport layer having a film thickness of 20 μm.

(2)

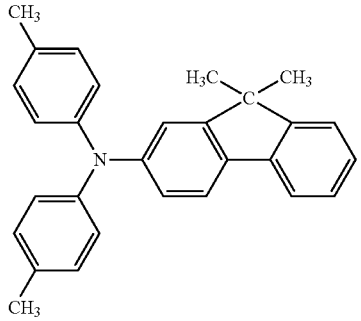

(3-1)

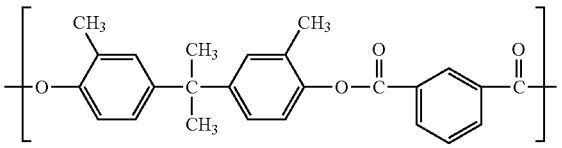

(3-2)

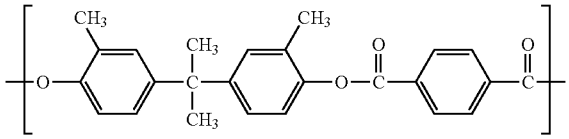

By doing as described above, the electrophotographic photosensitive member including the undercoat layer, the charge generation layer, and the charge transport layer on the support was produced.

(Evaluation of Adhesive Strength)

Evaluation of adhesive strength was performed by modifying a laser beam printer manufactured by Hewlett-Packard Company (product name: HP LaserJet Enterprise 600 M609dn, non-contact developing system, print speed: A4 portrait 71 sheets/min) as an evaluator. The produced electrophotographic photosensitive member was mounted on a process cartridge for HP LaserJet Enterprise 600 M609dn. In order to maintain spacing between the electrophotographic photosensitive member and a developer carrier, a spacing member formed of POM material having a rotatable cylindrical shape having a width of 4 mm was brought into contact with the center positioned at about 9 mm from one end and the other end of the support. A contact force was 25 N. Under the environment of a temperature of 15° C. and a humidity of 10% RH, image formation of 40,000 sheets was performed in an intermittent mode in which image formation is stopped whenever 2 sheets of image of a printing rate of 1% are formed with A4 size plain paper.

Evaluation of adhesive strength was performed by a crosscut test based on JIS K 5600-5-6: 1999. However, at the time of evaluation, the crosscut test was performed by after finishing image formation of 40,000 sheets, allowing the image to stand for 24 hours or more under the environment of a temperature of 15° C. and a humidity of 10% RH, and cutting as described below. Cutting was manually performed with a blade standing at about 60° against the coating film, using a single cutting tool. Since the produced coating film of the electrophotographic photosensitive member had a film thickness of 60 μm or less, cut spacing was set to 1 mm.

In the crosscut test, a portion of a width of 4 mm which is in contact with the spacing member of the electrophotographic photosensitive member, was manufactured into 16 squares, in which the number of cuts in each direction of the grid pattern being 5 with a width of 1 mm. This was performed for each two parts up and down, and evaluation was performed using an average value as to how many squares were peeled off out of 16 squares. The results are shown in Table 1.

(Evaluation of Potential Fluctuation Component)

Evaluation of a potential fluctuation component was performed in the same manner as in the evaluation of the adhesive strength. The produced electrophotographic photosensitive member was mounted on the process cartridge for HP LaserJet Enterprise 600 M609dn, and modification was performed so that a potential probe (product name: model 6000B-8, manufactured by TREK JAPAN) was mounted on a developing position). Thereafter, the potential at the center part (position at about 130 mm) of the electrophotographic photosensitive member was measured using a surface electrometer (product name: model 344, manufactured by TREK JAPAN). The surface potential of the electrophotographic photosensitive member was measured as described below. A light intensity of an image exposure was set so that an initial dark part potential ($Vd_0$) was −600 V and an initial bright part potential ($Vl_0$) was −150 V under the environment of a temperature of 15° C. and a humidity of 10% RH. For the exposure amount set under the condition (in which there was the potential probe in the developer part), image formation of 40,000 sheets was performed in the same manner as in the evaluation of the adhesive strength, and the bright part potential after repeated uses ($Vl_f$) was measured. The potential fluctuation component of the bright part potential, $\Delta Vl=Vl_f-Vl_0$ (unit: V) is shown in Table 1.

Examples 2 to 6

Electrophotographic photosensitive members were produced in the same manner as in Example 1, except that each parameter of Example 1 was changed as shown in Table 1, and the adhesive strength and the potential fluctuation component were evaluated in the same manner. The results are shown in Table 1.

Examples 7 to 9

Electrophotographic photosensitive members were produced in the same manner as in Example 1, except that in the manufacture of the rutile type titanium oxide particles which had been surface-treated with vinyltrimethoxysilane used in the coating solution for a undercoat layer of Example 1, 3.0 parts of vinyltrimethoxysilane was changed to 2.5 parts, 2.0 parts, and 5.0 parts of vinyltrimethoxysilane, respectively, and the adhesive strength and the potential fluctuation component were evaluated in the same manner. The results are shown in Table 1.

Example 10

An electrophotographic photosensitive member was produced in the same manner as in Example 1, except that the rutile type titanium oxide particles which had been surface-treated with vinyltrimethoxysilane used in the coating solution for an undercoat layer of Example 1 was produced as described below, and the adhesive strength and the potential fluctuation component were evaluated in the same manner. The results are shown in Table 1.

A hundred parts of rutile type titanium oxide particles (average primary particle diameter: 50 nm, manufactured by TAYCA CORPORATION) were mixed with 400 parts of methanol and 100 parts of methylethyl ketone with stirring, 3.5 parts of vinyltrimethoxysilane wherein m=0, n=3, and $R^1$ is a methyl group in Formula (1) (product name: KBM-1003, manufactured by Shin-Etsu Chemical Co., Ltd.) was added thereto, and stirring was performed for 8 hours. Thereafter, methanol and methylethyl ketone were distilled off by distillation under reduced pressure, and drying was performed at 120° C. for 3 hours, thereby obtaining rutile type titanium oxide particles which had been surface-treated with vinyltrimethoxysilane.

Example 11

An electrophotographic photosensitive member was produced in the same manner as in Example 1, except that the coating solution for an undercoat layer used in Example 1 was produced as described below, and the potential fluctuation component was evaluated in the same manner. The results are shown in Table 1.

With 500 parts of toluene, 100 parts of the rutile type titanium oxide particles (average primary particle diameter: 35 nm, manufactured by TAYCA CORPORATION) were mixed with stirring, and 4.3 parts of vinyltrimethoxysilane wherein m=0, n=3, and $R^1$ is a methyl group in Formula (1) (product name: KBM-1003, manufactured by Shin-Etsu Chemical Co., Ltd.) was added thereto, and stirring was performed for 8 hours. Thereafter, toluene was distilled off by distillation under reduced pressure, and drying was performed at 120° C. for 3 hours, thereby obtaining rutile type titanium oxide particles which had been surface-treated with vinyltrimethoxysilane.

To a mixed solvent of 90 parts of methanol and 60 parts of 1-butanol, 16 parts of the rutile type titanium oxide particles which had been surface-treated with vinyltrimethoxysilane, 6.0 parts of N-methoxymethylated nylon (product name: TORESIN EF-30T, manufactured by Nagase ChemteX Corporation), and 2.0 parts of a copolymerized nylon resin (product name: AMILAN CM8000, manufactured by Toray Industries, Inc.) were added, thereby preparing a dispersion solution.

This dispersion solution was dispersed for 5 hours with a vertical sand mill using glass beads having a diameter of 1.0 mm, and glass beads were removed, thereby preparing a coating solution for an undercoat layer.

Example 12

An electrophotographic photosensitive member was produced in the same manner as in Example 11, except that each parameter of Example 11 was changed as shown in Table 1, and the adhesive strength and the potential fluctuation component were evaluated in the same manner. The results are shown in Table 1.

Example 13

An electrophotographic photosensitive member was produced in the same manner as in Example 1, except that the coating solution for an undercoat layer used in Example 1 was prepared as described below, and the potential fluctuation component was evaluated in the same manner. The results are shown in Table 1.

With 500 parts of toluene, 100 parts of rutile type titanium oxide particles (average primary particle diameter: 15 nm, manufactured by TAYCA CORPORATION) were mixed with stirring, 10.0 parts of vinyltrimethoxysilane wherein m=0, n=3, and $R^1$ is a methyl group in Formula (1) (product name: KBM-1003, manufactured by Shin-Etsu Chemical Co., Ltd.) was added, and stirring was performed for 8 hours. Thereafter, toluene was distilled off by distillation under reduced pressure, and drying was performed at 120° C. for 3 hours, thereby obtaining rutile type titanium oxide particles which had been surface-treated with vinyltrimethoxysilane.

To a mixed solvent of 90 parts of methanol and 60 parts of 1-butanol, 12 parts of the rutile type titanium oxide particles which had been surface-treated with vinyltrimethoxysilane, 9.0 parts of N-methoxymethylated nylon (product name: TORESIN EF-30T, manufactured by Nagase ChemteX Corporation), and 3.0 parts of a copolymerized nylon resin (product name: AMILAN CM8000, manufactured by Toray Industries, Inc.) were added to prepare a dispersion solution.

This dispersion solution was dispersed for 5 hours with a vertical sand mill using glass beads having a diameter of 1.0 mm, and the glass beads were removed, thereby preparing a coating solution for an undercoat layer.

Examples 14 and 15

An electrophotographic photosensitive member was produced in the same manner as in Example 13, except that each parameter of Example 13 was changed as shown in Table 1, and the adhesive strength and the potential fluctuation component were evaluated in the same manner. The results are shown in Table 1.

Example 16

An electrophotographic photosensitive member was produced in the same manner as in Example 1, except that the coating solution for an undercoat layer used in Example 1 was prepared as described below, thereby producing an electrophotographic photosensitive member, and the potential fluctuation component was evaluated in the same manner. The results are shown in Table 1.

A hundred parts of rutile type titanium oxide particles (average primary particle diameter: 80 nm, manufactured by TAYCA CORPORATION) and 500 parts of toluene were mixed with stirring, 1.8 parts of vinyltrimethoxysilane wherein m=0, n=3, and $R^1$ is a methyl group in Formula (1) (product name: KBM-1003, manufactured by Shin-Etsu Chemical Co., Ltd.) was added thereto, and stirring was performed for 8 hours. Thereafter, toluene was distilled off by distillation under reduced pressure, and drying was performed at 120° C. for 3 hours, thereby obtaining rutile type titanium oxide particles which had been surface-treated with vinyltrimethoxysilane.

To a mixed solvent of 90 parts of methanol and 60 parts of 1-butanol, 19.8 parts of the rutile type titanium oxide particles which had been surface-treated with vinyltrimethoxysilane, 3.3 parts of N-methoxymethylated nylon (product name: TORESIN EF-30T, manufactured by Nagase ChemteX Corporation), and 1.1 parts of a copolymerized nylon resin (product name: AMILAN CM8000, manufactured by Toray Industries, Inc.) were added, thereby preparing a dispersion solution.

This dispersion solution was dispersed for 5 hours with a vertical sand mill using glass beads having a diameter of 1.0 mm, and glass beads were removed, thereby preparing a coating solution for an undercoat layer.

Examples 17 to 20

Electrophotographic photosensitive members were produced in the same manner as in Example 1, except that the surface treatment compounds of the rutile type titanium oxide particles of Example 1 were changed as shown in Table 1, and the adhesive strength and the potential fluctuation component were evaluated in the same manner. In Example 17, vinyltriethoxysilane (product name: KBE-1003, manufactured by Shin-Etsu Chemical Co., Ltd.) was used, in Example 18, vinyltriacetoxysilane (product name: Z-6075, manufactured by Dow Corning Toray Co., Ltd.) was used, in Example 19, vinyltris(2-methoxyethoxy)silane (product name: A-172, manufactured by Momentive Performance Materials) was used, and in Example 20, vinylmethyldimethoxysilane (product name: A-2171, manufactured by Momentive Performance Materials) was used. The results are shown in Table 1.

Example 21

An electrophotographic photosensitive member was produced in the same manner as in Example 1, except that the following conductive layer was formed between the support and the undercoat layer of Example 1, and the potential fluctuation component was evaluated in the same manner. The results are shown in Table 1.

To a solvent of 103 parts of 1-methoxy-2-propanol, 214 parts of titanium oxide particles coated with oxygen-deficient tin oxide, 132 parts of a phenol resin (product name: Plyophen J-325, Dainippon Ink and Chemicals, Incorporated) were added to prepare a dispersion solution.

This dispersion solution was added to a sand mill using glass beads having a diameter of 1.0 mm and dispersed for 3 hours, the glass beads were removed, and then 29 parts of a silicone resin particles (product name: TOSPEARL 120, manufactured by Momentive Performance Materials) and 0.03 parts of silicone oil (product name: SH28PA, manufactured by Dow Corning Toray Co., Ltd.) were added thereto, thereby preparing a coating solution for a conductive layer. This coating solution for a conductive layer was dip-coated on the support, and the obtained coating film was dried at 150° C. for 30 minutes, thereby forming a conductive layer having a film thickness of 30 μm.

Example 22

An electrophotographic photosensitive member was produced in the same manner as in Example 1, except that the following conductive layer was formed between the support and the undercoat layer of Example 1, and the potential fluctuation component was evaluated in the same manner. The results are shown in Table 1.

To a solvent of 98 parts of 1-methoxy-2-propanol, 207 parts of titanium oxide particles coated with phosphorus-doped tin oxide and 144 parts of a phenol resin (product name: Plyophen J-325, Dainippon Ink and Chemicals, Incorporated) were added to prepare a dispersion solution.

This dispersion solution was dispersed for 4.5 hours with a vertical sand mill using glass beads having a diameter of 1.0 mm, the glass beads were removed, and 44 parts of silicone resin particles (product name: TOSPEARL 120, manufactured by Momentive Performance Materials) and 0.03 parts of silicone oil (product name: SH28PA, manufactured by Dow Corning Toray Co., Ltd.) were added thereto, thereby preparing a coating solution for a conductive layer. This coating solution for a conductive layer was dip-coated on the support, and the obtained coating film was dried at 150° C. for 30 minutes, thereby forming a conductive layer having a film thickness of 30 μm.

Examples 23 and 24

Electrophotographic photosensitive members were produced in the same manner as in Example 1, except that in the manufacture of rutile type titanium oxide particles which had been surface-treated with vinyltrimethoxysilane used in the coating solution for an undercoat layer of Example 10, 3.5 parts of vinyltrimethoxysilane was changed to 5.0 parts and 3.0 parts of vinyltrimethoxysilane, respectively, and the adhesive strength and the potential fluctuation component were evaluated in the same manner. The results are shown in Table 1.

Example 25

An electrophotographic photosensitive member was produced in the same manner as in Example 1, except that each parameter of Example 10 was changed as shown in Table 1, and the adhesive strength and the potential fluctuation component were evaluated in the same manner. The results are shown in Table 1.

Example 26

An electrophotographic photosensitive member was produced in the same manner as in Example 1, except that in the manufacture of the rutile type titanium oxide particles which had been surface-treated with vinyltrimethoxysilane used in the coating solution for an undercoat layer of Example 1, 3.0 parts of vinyltrimethoxysilane was changed to 1.7 parts of vinyltrimethoxysilane, and the adhesive strength and the potential fluctuation component were evaluated in the same manner. The results are shown in Table 1.

Example 27

An electrophotographic photosensitive member was produced in the same manner as in Example 1, except that the undercoat layer of Example 1 was formed as described below, and the adhesive strength and the potential fluctuation component were evaluated in the same manner. The results are shown in Table 1.

To a mixed solvent of 90 parts of methanol and 60 parts of 1-butanol, 16.2 parts of the rutile type titanium oxide particles which had been surface-treated with vinyltrimethoxysilane of Example 1, 4.5 parts of N-methoxymethylated nylon (product name: TORESIN EF-30T, manufactured by Nagase ChemteX Corporation), and 1.5 parts of a copolymerized nylon resin (product name: AMILAN CM8000, manufactured by Toray Industries, Inc.) were added, thereby preparing a dispersion solution.

This dispersion solution was dispersed for 5 hours with a vertical sand mill using glass beads having a diameter of 1.0 mm, thereby preparing a coating solution for an undercoat layer. This coating solution for an undercoat layer was dip-coated on the support, and the obtained coating film was dried at 100° C. for 10 minutes, thereby forming an undercoat layer having a film thickness of 1.5 μm.

Example 28

An electrophotographic photosensitive member was produced in the same manner as in Example 1, except that the coating solution for an undercoat layer of Example 1 was prepared as described below, and the adhesive strength and the potential fluctuation component were evaluated in the same manner. The results are shown in Table 1.

To a mixed solvent of 90 parts of methanol and 60 parts of 1-butanol, 22 parts of the rutile type titanium oxide particles which had been surface-treated with vinyltrimethoxysilane of Example 1, 4.5 parts of N-methoxymethylated nylon (product name: TORESIN EF-30T, manufactured by Nagase ChemteX Corporation), and 1.5 parts of a copolymerized nylon resin (product name: AMILAN CM8000, manufactured by Toray Industries, Inc.) were added, thereby preparing a dispersion solution.

Comparative Example 1

An electrophotographic photosensitive member was produced in the same manner as in Example 1, except that the undercoat layer used in Example 1 was formed as described below, and the potential fluctuation component was evaluated in the same manner. The results are shown in Table 1.

A hundred parts of rutile type titanium oxide particles (average primary particle diameter: 35 nm, manufactured by TAYCA CORPORATION) was mixed with 500 parts of toluene with stirring, 3.5 parts of a copolymer of methylhydrogensiloxane and dimethylsiloxane (a mole ratio of 1:1) was added thereto, and stirring was performed for 8 hours. Thereafter, toluene was distilled off by distillation under reduced pressure, and drying was performed at 120° C. for 3 hours, thereby obtaining rutile type titanium oxide particles which had been surface-treated with a copolymer of methylhydrogensiloxane and dimethylsiloxane.

Fourteen parts of rutile type titanium oxide particles which had been surface-treated with the copolymer of methylhydrogensiloxane and dimethylsiloxane, and 4 parts of a polyamide resin having a structural unit represented by the following Formula (4-1), a structural unit represented by the following Formula (4-2), and a structural unit represented by the following Formula (4-3) at a ratio of 2/6/2 were added to a mixed solvent of 18 parts of ethanol, 8 parts of 1-propanol, and 12 parts of tetrahydrofuran to prepare a dispersion solution.

(4-1)

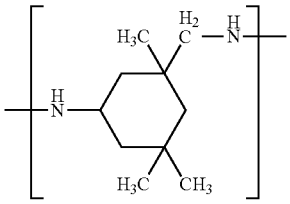

(4-2)

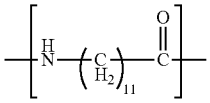

-continued (4-3)

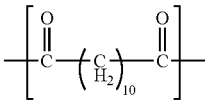

This dispersion solution was dispersed for 10 hours with a vertical sand mill using glass beads having a diameter of 1.0 mm, and the glass beads were removed, thereby preparing a coating solution for an undercoat layer. This coating solution for an undercoat layer was dip-coated on the support, and the obtained coating film was dried at 120° C. for 30 minutes, thereby forming an undercoat layer having a film thickness of 1.0 μm.

Comparative Example 2

An electrophotographic photosensitive member was produced in the same manner as in Example 1, except that the undercoat layer used in Example 1 was formed as described below, and the potential fluctuation component was evaluated in the same manner. The results are shown in Table 1.

A hundred parts of anatase type titanium oxide particles (average primary particle: 50 nm, manufactured by FUJI TITANIUM INDUSTRY CO., LTD.) was mixed with 200 parts of toluene with stirring, 0.5 parts of vinyltrimethoxysilane (product name: KBM-1003, manufactured by Shin-Etsu Chemical Co., Ltd.) was added thereto, and stirring was performed for 2 hours. Thereafter, toluene was distilled off by distillation under reduced pressure, and drying was performed at 135° C. for 2 hours, thereby obtaining anatase type titanium oxide particles which had been surface-treated with vinyltrimethoxysilane.

To 25 parts of methylethyl ketone, 33 parts of the anatase type titanium oxide particles which had been surface-treated with vinyltrimethoxysilane, 6 parts of a block isocyanate compound represented by the following Formula (5), 5 parts of a polyvinylbutyral resin (product name: BM-1, manufactured by SEKISUI CHEMICAL CO., LTD.), and 1 part of alizarin as an additive were added to prepare a dispersion solution.

(5)

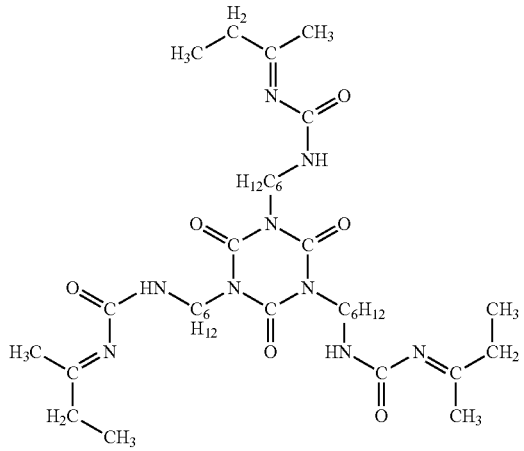

This dispersion solution was dispersed for 3 hours with a vertical sand mill using glass beads having a diameter of 1.0 mm, the glass beads were removed, and 3 parts of silicone resin particles (product name: TOSPEARL 130, manufactured by Momentive Performance Materials) were added, thereby preparing a coating solution for an undercoat layer. This coating solution for an undercoat layer was dip-coated on the support, and the obtained coating film was dried at 180° C. for 30 minutes, thereby forming an undercoat layer having a film thickness of 20.0 μm.

Comparative Example 3

An electrophotographic photosensitive member was produced in the same manner as in Example 1, except that the undercoat layer and the charge generation layer used in Example 1 were formed as described below, and the potential fluctuation component was performed in the same manner. The results are shown in Table 1.

A hundred parts of rutile type titanium oxide particles (average primary particle diameter: 50 nm, manufactured by TAYCA CORPORATION) were mixed with 500 parts of toluene with stirring, 0.1 parts of 3-acryloxypropyltrimethoxysilane (product name: KBM-5103, manufactured by Shin-Etsu Chemical Co., Ltd.) were added thereto, and stirring was performed for 8 hours. Thereafter, toluene was distilled off by distillation under reduced pressure, and drying was performed at 120° C. for 3 hours, thereby obtaining rutile type titanium oxide particles which had been surface-treated with 3-acryloxypropyltrimethoxy silane.

To a mixed solvent of 29 parts of methanol and 53 parts of 1,2-dichloroethane, 17 parts of the rutile type titanium oxide particles which had been surface-treated with 3-acryloxypropyltrimethoxysilane and 1 part of a copolymerized nylon resin (product name: AMILAN CM8000, manufactured by Toray Industries, Inc.) were added, thereby preparing a dispersion solution.

This dispersion solution was dispersed for 8 hours with a vertical sand mill using glass beads having a diameter of 1.0 mm, and the glass beads were removed, thereby preparing a coating solution for an undercoat layer. This coating solution for an undercoat layer was dip-coated on the support, and the obtained coating film was dried at 110° C. for 10 minutes, thereby forming an undercoat layer having a film thickness of 3.0 μm.

Then, 15 parts of a bisazo pigment represented by the following Formula (6) (charge generating material) and 15 parts of a phenoxy resin (product name: PKHH, manufactured by Union Carbide Corporation) were added to a solvent of 100 parts of 1,2-dimethoxyethane to prepare a dispersion solution. This dispersion solution was added to a vertical sand mill using glass beads having a diameter of 1.0 mm and dispersed for 8 hours, and the glass beads were removed, thereby preparing a coating solution for a charge generation layer. This coating solution for a charge generation layer was dip-coated on the undercoat layer, and the obtained coating film was dried at 90° C. for 10 minutes, thereby forming a charge generation layer having a film thickness of 0.80 μm.

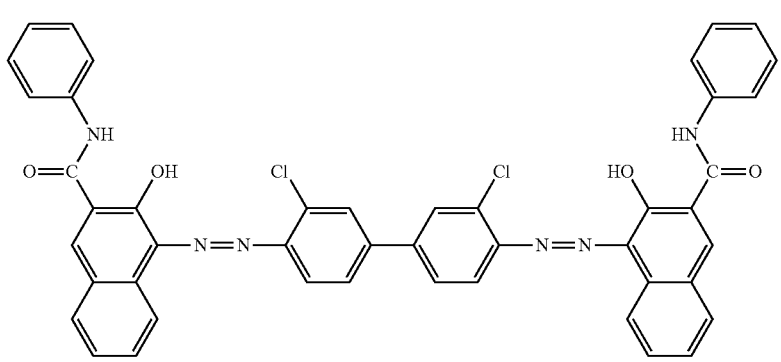

(6)

Comparative Example 4

An electrophotographic photosensitive member was produced in the same manner as in Comparative Example 3, except that 3-acryloxypropyltrimethoxysilane (product name: KBM-5103, manufactured by Shin-Etsu Chemical Co., Ltd.) of Comparative Example 3 was replaced with vinyltriethoxysilane (product name: KBE-1003, manufactured by Shin-Etsu Chemical Co., Ltd.), and the adhesive strength and the potential fluctuation component were evaluated in the same manner. The results are shown in Table 1.

Comparative Example 5

An electrophotographic photosensitive member was produced in the same manner as in Example 1, except that vinyltrimethoxysilane (product name: KBM-1003, manufactured by Shin-Etsu Chemical Co., Ltd.) of Example 1 was replaced with octyltrimethoxysilane (product name: KBE-3083, manufactured by Shin-Etsu Chemical Co., Ltd.), and the adhesive strength and the potential fluctuation component were evaluated in the same manner. The results are shown in Table 1.

TABLE 1

Preparation conditions and evaluation results

| | Preparation condition | | | | | | | | | | | | | | Evaluation result | |
|---|---|---|---|---|---|---|---|---|---|---|---|---|---|---|---|---|
| | Surface-treated compound of titanium oxide particles Formula (1) | | | | Parameter | | | | | Equation (A) | Equation (B) | Equation (C) | Equation (D) | Equation (E) | Adhesive strength: number of | Potential fluctuation: |
| Example No. | $R^1$ | $R^2$ | m | n | a | b [μm] | c [wt %] | d [μm] | e [%] | a/b | b × c | d | a/d | bce | peeled squares | ΔV1 [V] |
| Example 1 | $CH_3$ | — | 0 | 3 | 0.78 | 0.050 | 0.45 | 2.0 | 10 | 15.6 | 0.023 | 2.0 | 0.39 | 0.23 | 2.5 | 38 |
| Example 2 | $CH_3$ | — | 0 | 3 | 0.78 | 0.050 | 0.45 | 0.3 | 10 | 15.6 | 0.023 | 0.3 | 2.60 | 0.23 | 9.0 | 19 |
| Example 3 | $CH_3$ | — | 0 | 3 | 0.78 | 0.050 | 0.45 | 0.5 | 10 | 15.6 | 0.023 | 0.5 | 1.56 | 0.23 | 7.0 | 22 |
| Example 4 | $CH_3$ | — | 0 | 3 | 0.78 | 0.050 | 0.45 | 1.0 | 10 | 15.6 | 0.023 | 1.0 | 0.78 | 0.23 | 4.5 | 33 |
| Example 5 | $CH_3$ | — | 0 | 3 | 0.78 | 0.050 | 0.45 | 3.0 | 10 | 15.6 | 0.023 | 3.0 | 0.26 | 0.23 | 1.5 | 52 |
| Example 6 | $CH_3$ | — | 0 | 3 | 0.78 | 0.050 | 0.45 | 5.0 | 10 | 15.6 | 0.023 | 5.0 | 0.16 | 0.23 | 1.0 | 69 |
| Example 7 | $CH_3$ | — | 0 | 3 | 0.78 | 0.050 | 0.30 | 2.0 | 0 | 15.6 | 0.015 | 2.0 | 0.39 | 0.00 | 5.5 | 31 |
| Example 8 | $CH_3$ | — | 0 | 3 | 0.78 | 0.050 | 0.38 | 2.0 | 4 | 15.6 | 0.019 | 2.0 | 0.39 | 0.08 | 4.0 | 35 |
| Example 9 | $CH_3$ | — | 0 | 3 | 0.78 | 0.050 | 0.54 | 2.0 | 26 | 15.6 | 0.027 | 2.0 | 0.39 | 0.70 | 2.5 | 42 |
| Example 10 | $CH_3$ | — | 0 | 3 | 0.78 | 0.050 | 0.60 | 2.0 | 31 | 15.6 | 0.030 | 2.0 | 0.39 | 0.93 | 2.0 | 47 |
| Example 11 | $CH_3$ | — | 0 | 3 | 0.52 | 0.035 | 0.67 | 2.0 | 18 | 14.9 | 0.023 | 2.0 | 0.26 | 0.42 | 3.0 | 44 |
| Example 12 | $CH_3$ | — | 0 | 3 | 0.52 | 0.035 | 0.67 | 1.5 | 18 | 14.9 | 0.023 | 1.5 | 0.35 | 0.42 | 4.0 | 29 |
| Example 13 | $CH_3$ | — | 0 | 3 | 0.26 | 0.015 | 1.76 | 2.0 | 20 | 17.3 | 0.026 | 2.0 | 0.13 | 0.53 | 1.0 | 68 |
| Example 14 | $CH_3$ | — | 0 | 3 | 0.26 | 0.015 | 1.76 | 0.8 | 20 | 17.3 | 0.026 | 0.8 | 0.32 | 0.53 | 2.5 | 35 |
| Example 15 | $CH_3$ | — | 0 | 3 | 0.26 | 0.015 | 1.76 | 1.5 | 20 | 17.3 | 0.026 | 1.5 | 0.17 | 0.53 | 1.0 | 55 |
| Example 16 | $CH_3$ | — | 0 | 3 | 1.17 | 0.080 | 0.35 | 2.0 | 15 | 14.6 | 0.028 | 2.0 | 0.58 | 0.42 | 2.5 | 45 |
| Example 17 | $C_2H_5$ | — | 0 | 3 | 0.78 | 0.050 | 0.45 | 2.0 | 18 | 15.6 | 0.023 | 2.0 | 0.39 | 0.41 | 2.5 | 39 |
| Example 18 | $COCH_3$ | — | 0 | 3 | 0.78 | 0.050 | 0.45 | 2.0 | 25 | 15.6 | 0.023 | 2.0 | 0.39 | 0.56 | 3.5 | 44 |
| Example 19 | $CH_2CH_2OCH_3$ | — | 0 | 3 | 0.78 | 0.050 | 0.45 | 2.0 | 32 | 15.6 | 0.023 | 2.0 | 0.39 | 0.72 | 3.0 | 45 |
| Example 20 | $CH_3$ | $CH_3$ | 1 | 2 | 0.78 | 0.050 | 0.39 | 2.0 | 16 | 15.6 | 0.020 | 2.0 | 0.39 | 0.31 | 3.0 | 36 |
| Example 21 | $CH_3$ | — | 0 | 3 | 0.78 | 0.050 | 0.45 | 2.0 | 10 | 15.6 | 0.023 | 2.0 | 0.39 | 0.23 | 2.0 | 41 |
| Example 22 | $CH_3$ | — | 0 | 3 | 0.78 | 0.050 | 0.45 | 2.0 | 10 | 15.6 | 0.023 | 2.0 | 0.39 | 0.23 | 2.0 | 45 |
| Example 23 | $CH_3$ | — | 0 | 3 | 0.78 | 0.050 | 0.70 | 2.0 | 45 | 15.6 | 0.035 | 2.0 | 0.39 | 1.58 | 2.5 | 58 |
| Example 24 | $CH_3$ | — | 0 | 3 | 0.78 | 0.050 | 0.52 | 2.0 | 17 | 15.6 | 0.026 | 2.0 | 0.39 | 0.44 | 2.0 | 44 |
| Example 25 | $CH_3$ | — | 0 | 3 | 0.78 | 0.050 | 0.60 | 1.5 | 30 | 15.6 | 0.030 | 1.5 | 0.52 | 0.90 | 3.0 | 38 |
| Example 26 | $CH_3$ | — | 0 | 3 | 0.78 | 0.050 | 0.25 | 2.0 | 0 | 15.6 | 0.013 | 2.0 | 0.39 | 0.00 | 7.5 | 26 |
| Example 27 | $CH_3$ | — | 0 | 3 | 0.70 | 0.050 | 0.45 | 1.5 | 10 | 14.0 | 0.023 | 1.5 | 0.47 | 0.23 | 3.5 | 39 |
| Example 28 | $CH_3$ | — | 0 | 3 | 0.95 | 0.050 | 0.45 | 2.0 | 10 | 19.1 | 0.023 | 2.0 | 0.48 | 0.23 | 4.0 | 33 |
| Comparative Example 1 | Copolymer of methylhydrogensiloxane:dimethylsiloxane = 1:1 | | | | 1.00 | 0.035 | 0.46 | 1.0 | 45 | 28.6 | 0.016 | 1.0 | 1.00 | 0.72 | 12.0 | 80 |
| Comparative Example 2 | $CH_3$ | — | 0 | 3 | 1.20 | 0.050 | 0.07 | 20.0 | 0 | 23.9 | 0.004 | 20.0 | 0.06 | 0.00 | 14.0 | 66 |
| Comparative Example 3 | 3-Acryloxypropyltrimethoxysilane | | | | 4.42 | 0.050 | 0.01 | 3.0 | 0 | 88.4 | 0.001 | 3.0 | 1.47 | 0.00 | 13.5 | 122 |
| Comparative Example 4 | $C_2H_5$ | — | 0 | 3 | 4.42 | 0.050 | 0.01 | 3.0 | 0 | 88.4 | 0.001 | 3.0 | 1.47 | 0.00 | 13.5 | 105 |
| Comparative Example 5 | Octyltrimethoxysilane | | | | 0.78 | 0.050 | 0.40 | 2.0 | 88 | 15.6 | 0.020 | 2.0 | 0.39 | 1.76 | 9.5 | 109 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-021340, filed Feb. 8, 2018, which is hereby incorporated by reference herein in its entirety.

What is claimed is:

1. An electrophotographic photosensitive member comprising: a support, an undercoat layer formed above the support, a charge generation layer formed on the undercoat layer, and a charge transport layer formed above the charge generation layer, wherein the undercoat layer contains a polyamide resin and a titanium oxide particle which is surface-treated with a compound represented by Formula (1):

(1)

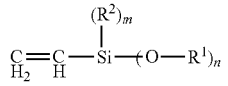

wherein $R^1$ denotes a methyl group, an ethyl group, an acetyl group, or a 2-methoxyethyl group; $R^2$ denotes a hydrogen atom or a methyl group; and m+n=3, m is an integer of 0 or more, and n is an integer of 1 or more, with a proviso that when n is 3, m is 0;

when a volume of the titanium oxide particles to a volume of the polyamide resin in the undercoat layer is a, and an average primary particle diameter of the titanium oxide particles is b (μm), the following Equation (A) is satisfied:

$$14.0 \leq a/b \leq 19.1 \quad \text{Equation (A):}$$

and the charge generation layer contains a charge generating material and a polyvinyl butyral resin having a hydroxyl group and a hydroxyl number of 100 mgKOH/g or more, and wherein the undercoat layer has a thickness of 0.5 to 3.0 μm.

2. The electrophotographic photosensitive member according to claim 1, wherein the titanium oxide particle contains Si element derived of the compound represented by Formula (I), of c % by mass with respect to $TiO_2$ in the titanium oxide particle , and wherein b and c satisfy the following Equation (B):

$$0.015 \leq b \times c \leq 0.030 \quad \text{Equation (B).}$$

3. The electrophotographic photosensitive member according to claim 1, wherein the undercoat layer has a film thickness d (μm) satisfying the following Equation (C):

$$0.5 \leq d \leq 3.0 \quad \text{Equation (C).}$$

4. The electrophotographic photosensitive member according to claim 3, wherein the undercoat layer satisfies the following Equation D:

$$0.15 \leq a/d \leq 0.55 \quad \text{Equation (D).}$$

5. The electrophotographic photosensitive member according to claim 1, wherein the compound represented by Formula (1) is at least one member selected from the group consisting of vinyltriethoxysilane and vinylmethyldimethoxysilane.

6. The electrophotographic photosensitive member according to claim 1, wherein the titanium oxide particles have an average primary particle diameter b (μm) of 0.015 or more and 0.085 or less.

7. The electrophotographic photosensitive member according to claim 1, wherein the charge generating material is hydroxygallium phthalocyanine.

8. A process cartridge integrally supporting an electrophotographic photosensitive member, and at least one unit selected from the group consisting of a charging unit, a developing unit, and a cleaning unit, and being detachably attached to an electrophotographic apparatus body, wherein the electrophotographic photosensitive member comprises: a support, an undercoat layer formed above the support, a charge generation layer formed on the undercoat layer, and a charge transport layer formed above the charge generation layer;

the undercoat layer contains a polyamide resin and a titanium oxide particle which is surface-treated with a compound represented by Formula (1):

(1)

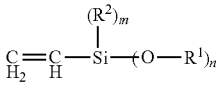

wherein $R^1$ denotes a methyl group, an ethyl group, an acetyl group, or a 2-methoxyethyl group; $R^2$ denotes a hydrogen atom or a methyl group; and m+n=3, m is an integer of 0 or more, and n is an integer of 1 or more, with a proviso that when n is 3, m is 0;

when a volume of the titanium oxide particles to a volume of the polyamide resin in the undercoat layer is a, and an average primary particle diameter of the titanium oxide particles is b (μm), the following Equation (A) is satisfied:

$$14.0 \leq a/b \leq 19.1 \quad \text{Equation (A):}$$

and the charge generation layer contains a charge generating material and a polyvinyl butyral resin having a hydroxyl group and a hydroxyl number of 100 mgKOH/g or more, and wherein the undercoat layer has a thickness of 0.5 to 3.0 μm.

9. An electrophotographic apparatus comprising:

an electrophotographic photosensitive member, a charging unit, an exposing unit, a developing unit, and a transferring unit, wherein the electrophotographic photosensitive member comprises: a support, an undercoat layer formed above the support, a charge generation layer formed on the undercoat layer, and a charge transport layer formed above the charge generation layer;

the undercoat layer contains a polyamide resin and a titanium oxide particle which is surface-treated with a compound represented by Formula (1):

(1)

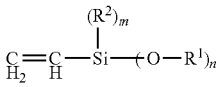

wherein $R^1$ denotes a methyl group, an ethyl group, an acetyl group, or a 2-methoxyethyl group; $R^2$ denotes a hydrogen atom or a methyl group; and m+n=3, m is an integer of 0 or more, and n is an integer of 1 or more, with a proviso that when n is 3, m is 0;

when a volume of the titanium oxide particles to a volume of the polyamide resin in the undercoat layer is a, and an average primary particle diameter of the titanium oxide particles is b (μm), the following Equation (A) is satisfied:

$$14.0 \leq a/b \leq 19.1 \quad \text{Equation (A):}$$

and the charge generation layer contains a charge generating material and a polyvinyl butyral resin having a hydroxyl group and a hydroxyl number of 100 mgKOH/g or more, and wherein the undercoat layer has a thickness of 0.5 to 3.0 μm.

10. The electrophotographic photosensitive member according to claim 1, wherein the compound represented by Formula (1) is vinyltrimethoxysilane.

11. The electrophotographic photosensitive member according to claim 2, wherein when a value of a hydrophobized degree of the titanium oxide particles is defined as e, the following Equation (E) is satisfied:

$$0.25 \leq b \times c \times e \leq 1.05 \quad \text{Equation (E).}$$

12. The electrophotographic photosensitive member according to claim 11, wherein e is 10 or more and 40 or less.

13. The electrophotographic photosensitive member according to claim 1, wherein a is 0.2 or more and 1.0 or less.

* * * * *